United States Patent [19]

Roberts, II

[11] Patent Number: 4,848,650

[45] Date of Patent: Jul. 18, 1989

[54] RURAL MAILBOX

[76] Inventor: John C. Roberts, II, 714 Tolland Stage Rd., Tolland, Conn. 06084

[21] Appl. No.: 245,896

[22] Filed: Sep. 19, 1988

[51] Int. Cl.[4] ..... B65D 91/00

[52] U.S. Cl. ..... 232/17; 232/43.2; 232/43.4

[58] Field of Search ..... 232/17, 19, 20, 43.2, 232/43.4

[56] References Cited

U.S. PATENT DOCUMENTS

| | | | |
|---|---|---|---|
| 838,194 | 12/1906 | Larsh | 232/17 |
| 1,397,438 | 11/1921 | Martin | 232/24 X |
| 3,106,335 | 10/1963 | Allan | 232/17 |
| 3,874,583 | 4/1975 | Moll | 232/17 |
| 3,942,715 | 3/1976 | Anderson | 232/17 |
| 4,160,520 | 7/1979 | Cluthé232 | 17/ |
| 4,600,143 | 7/1986 | Harlow et al. | 232/17 |
| 4,753,386 | 6/1988 | Phillion | 232/17 X |
| 4,757,942 | 7/1988 | Young | 232/17 |

*Primary Examiner*—Robert W. Gibson, Jr.
*Attorney, Agent, or Firm*—Peter R. Bahn

[57] ABSTRACT

A rural mailbox with a front inward swinging double door for mail delivery, a back door for mail retrieval, and a forward-and-backward sliding drawer for insertion and pickup of outgoing mail.

2 Claims, 1 Drawing Sheet

RURAL MAILBOX

DESCRIPTION OF THE INVENTION

Figure 1:
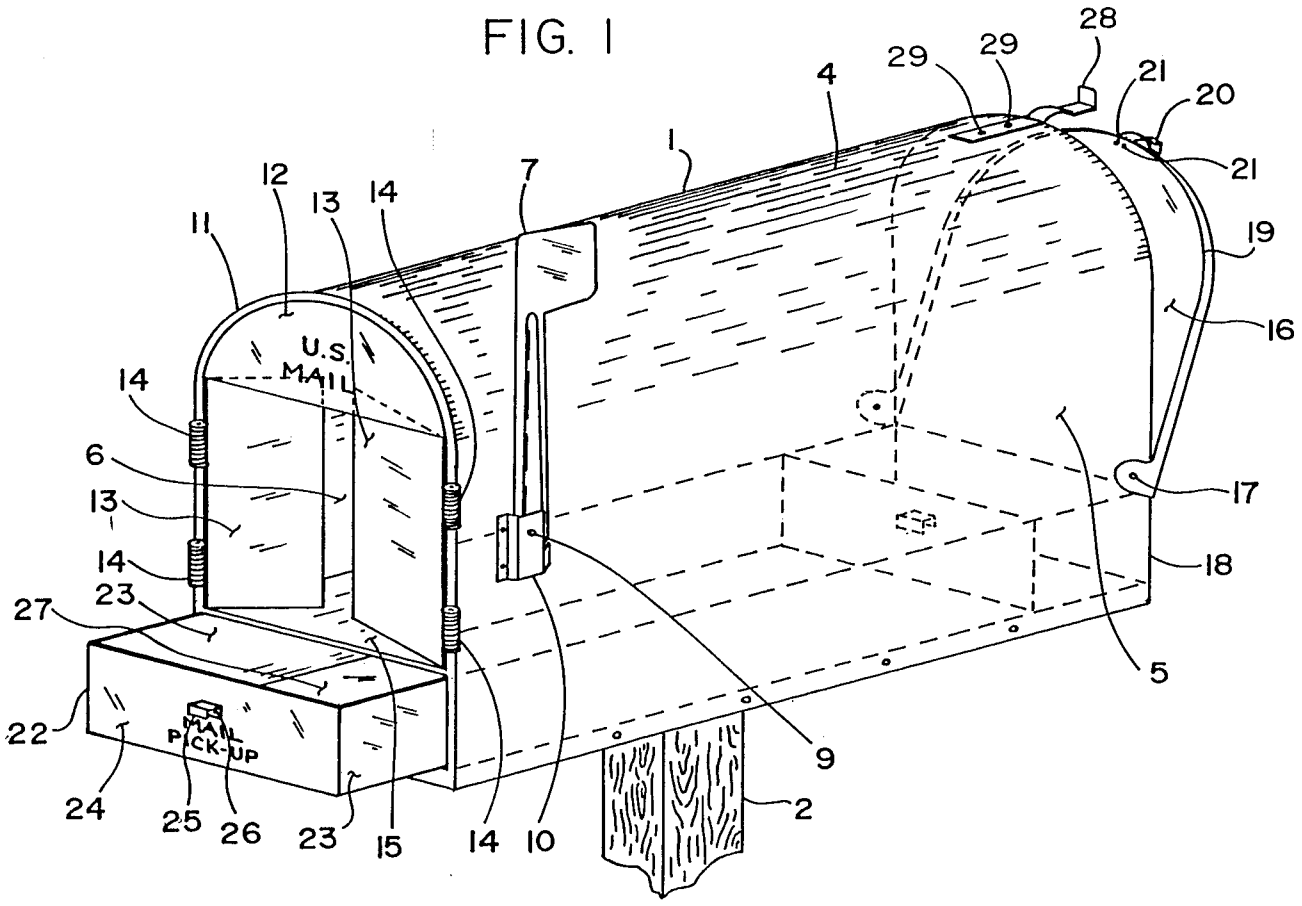

This invention belongs in the category of receptacles in general, mailboxes in particular, and rural mailboxes specifically.

Mailboxes generally are of two types, the urban mailbox and the rural mailbox. Urban mailboxes are those types of mailboxes which are physically attached to the dwelling units they service. Rural mailboxes are those types of mailboxes which are physically separate from the dwelling units they service. Rural mailboxes usually have the shape of oblong boxes with rounded tops and are mounted on posts very close to the side of the roads in front of the houses that they service. The proximity of rural mailboxes to the edge of the road allows the mail carrier to deposit mail in the rural mailbox without getting out of his mail carrier vehicle since the door to such typical rural mailboxes faces the roadside.

Unfortunately, the fact that the single door to the typical rural mailbox does face the roadside means that the owner of the mailbox must virtually step out onto the roadside to retrieve his mail or to place outgoing mail into the mailbox. Undoubtedly, a number of citizens are accidentally killed every year by speeding cars while accessing such typical rural mailboxes as they step into the street to retrieve or send their mail.

The invention to be described here has the object of preventing such needless traffic fatalities while at the same time making it easier for the mail carrier to pick up and deposit mail.

The objects of this invention are accomplished, in essence, by providing a mailbox with a front opening for mail deposition by the carrier, a rear opening for mail retrieval by the owner, and a front-and-rear accessible drawer for placement of outgoing mail. By virtue of such a mailbox, it is not necessary for the owner to go around to the front of his mailbox and into the road. All mail which the owner retrieves and deposits may be obtained from the rear of the mailbox, away from the roadside.

The nature of this invention is shown in the accompanying drawing, FIG. 1.

Thus, it is seen that the mailbox 1 is mounted on a post 2 which is rigidly attached to the bottom 3 of the mailbox. As is the case with typical rural mailboxes, the top 4 of this mailbox is rounded and the sides 5 and 6 of the mailbox are planar. Also, as is the case with typical rural mailboxes, this mailbox possesses a signal flag 7 and mast 8 which is pivotable through an angle of 90° about a flag axle 9 and which is attached to the mailbox via a flag base plate 10. The flag 7 is located near the front end 11 of the mailbox and is used to signal the mail carrier that the mailbox contains outgoing mail. When the mail carrier picks up such outgoing mail, he then rotates the flag 7 down into a horizontal position to indicate to the owner that the outgoing mail has been picked up.

This mailbox possesses a top front plate 12 labeled with the words "U.S. MAIL". The mailbox also possesses two front doors 13 mounted on spring-loaded hinges 14 (two hinges per door). Normally the doors 13 are closed and flush with the top front plate 12 of the mailbox, but when pushed both doors open inwardly to allow access from the front into the interior of the mailbox.

When the mail carrier is delivering mail to this mailbox, he simply takes the mail in one hand and pushes it through the front doors 13 into the mailbox interior and places it on the main floor 15 of the mailbox. The spring-loaded doors 13 close automatically. This mailbox makes it possible for the mail carrier to deposit mail with a single quick motion of his arm. Typical rural mailboxes which have outward opening front doors on non-spring-loaded hinges require at least three motions of the mail carrier's arm to deposit mail: one motion to open the door, a second motion to put the mail into the mailbox, and a third motion to close the door. Considering the fact that a single mail carrier must deliver mail to many mailboxes during the day, it is evident that the mailbox described here saves the mail carrier from expending much wasted motion. In addition, the fact that the front doors of this mailbox only open inwardly makes it easy to push mail through the doors into the mailbox but more difficult for an unauthorized person to snatch delivered mail out of the mailbox from the front. Such feature of this mailbox helps prevent delivered mail from being stolen by a thief who presumably would not wish to linger in front of the mailbox any longer than possible.

The swinging double door feature of this mailbox would also make it difficult for the owner to retrieve his delivered mail if it were not for the fact that this mailbox possesses a non-spring-loaded owner access door 16 attached via two hinger 17 two hinges 17 to the rear 18 of the mail box. The door 16 possesses a lip which fits over the rear edge of the mailbox. The door 16 also possesses a finger grip 20 held by two rivets 21 and which is held closed by a latch 28 held by two rivets 29.

The rear door 16 of this mailbox is a feature which makes it possible for the owner to retrieve his mail without going around to the front of the mailbox, thereby avoiding having to step out onto the road, and thereby avoiding the consequent danger of traffic fatalities.

For the purpose of holding outgoing mail, this mailbox possesses a drawer 22 which is located under the main floor 15 of the mailbox. The rectangular drawer has two sides 23 a flat bottom, and a flat back end, which are indicated by broken lines. The flat front end 24 of the drawer 22 is labeled with the words "MAIL PICKUP" and has a finger grip rigidly attached to it by two rivets 26 (only one shown). The back end of the drawer 22 similarly has another finger grip attached to it. The bottom compartment of the mailbox 1 which houses the drawer 22 is open at the front 11 of the mailbox and also the rear 18 of the mailbox so that the drawer 22 can be pulled open in either a forward direction towards the road or in a backward direction towards the dwelling unit.

When the owner desires to send outgoing mail he simply pulls the drawer 22 out from the rear end 18 of the mailbox, places such mail into the interior 27 of the drawer 22, and closes the drawer so that its back end is flush with the rear end 18 of the mailbox. He then puts the signal flag 7 upright in a vertical position to indicate to the mail carrier that the mailbox contains outgoing mail.

When the mail carrier arrives to service the mailbox, he simply pulls the drawer 22 out from the front end 11 of the mailbox, takes the outgoing mail out of the interior 27 of the drawer 22, closes the drawer 22 so that its front end 24 is flush with the front end 11 of the mailbox, and puts the signal flag 7 down into a horizontal position to indicate to the owner that the outgoing mail has been picked up.

What is claimed is:

1. A rural type mailbox with a front door for mail delivery, a back door for mail retrieval, and a forward-and-backward sliding drawer for insertion and pickup of outgoing mail, wherein said front door for mail delievery normally is flush with the front end of the said mailbox but opens by swinging inward toward the mailbox interior.

2. A rural type mailbox with a front door for mail delivery, a back door for mail retrieval, and a forward-and-backward sliding drawer for insertion and pickup of outgoing mail, wherein the said front door for mail delivery is a double segment swinging door.

* * * * *